US005857802A

United States Patent [19]

Richter

[11] Patent Number: 5,857,802

[45] Date of Patent: Jan. 12, 1999

[54] REFLECTOR STUDS FOR ROADS

[76] Inventor: Wolf Dieter Richter, 106 Old Main Road, Botha's Hill 3660, South Africa

[21] Appl. No.: 632,396

[22] PCT Filed: Oct. 19, 1994

[86] PCT No.: PCT/EP94/03440

§ 371 Date: Aug. 29, 1996

§ 102(e) Date: Aug. 29, 1996

[87] PCT Pub. No.: WO95/11347

PCT Pub. Date: Apr. 27, 1995

[30] Foreign Application Priority Data

Oct. 20, 1993 [ZA] South Africa ..... 93/7783

[51] Int. Cl.[6] ..... E01F 9/06

[52] U.S. Cl. ..... 404/14; 404/16

[58] Field of Search ..... 404/9, 13, 14, 404/15, 16

[56] References Cited

U.S. PATENT DOCUMENTS

| | | | |
|---|---|---|---|
| 3,485,148 | 12/1969 | Heenan . | |
| 3,971,623 | 7/1976 | Hedgewick et al. | 404/16 X |
| 3,975,108 | 8/1976 | Suhr et al. . | |
| 4,127,348 | 11/1978 | Roberts . | |
| 4,232,979 | 11/1980 | Johnson, Jr. et al. . | |
| 4,358,217 | 11/1982 | Stone . | |
| 4,428,320 | 1/1984 | Oplt et al. | 404/14 X |
| 4,445,803 | 5/1984 | Dixon . | |
| 4,521,129 | 6/1985 | Krech et al. . | |
| 4,534,673 | 8/1985 | May . | |
| 4,577,992 | 3/1986 | Jefferies . | |
| 4,594,021 | 6/1986 | Schäfer . | |
| 4,618,281 | 10/1986 | Ajemian . | |
| 4,634,310 | 1/1987 | Clarke . | |
| 4,653,955 | 3/1987 | Racs . | |
| 4,659,248 | 4/1987 | Flanagan . | |
| 4,717,281 | 1/1988 | Shepherd et al. . | |
| 4,726,706 | 2/1988 | Attar . | |
| 4,753,548 | 6/1988 | Forrer . | |
| 4,797,024 | 1/1989 | Forrer . | |
| 4,815,890 | 3/1989 | Duncan . | |
| 4,883,384 | 11/1989 | Hedgewick . | |
| 5,061,114 | 10/1991 | Hedgewick . | |
| 5,098,217 | 3/1992 | Hedgewick et al. . | |
| 5,104,256 | 4/1992 | D'Avela . | |
| 5,173,099 | 12/1992 | Chen . | |
| 5,226,745 | 7/1993 | Gartlacher . | |
| 5,240,344 | 8/1993 | Green . | |
| 5,327,850 | 7/1994 | Sly et al. . | |

FOREIGN PATENT DOCUMENTS

| | | |
|---|---|---|
| 1572079 | 6/1969 | France . |
| 873 224 | 4/1953 | Germany . |
| 323261 | 9/1957 | Switzerland . |
| 375747 | 4/1964 | Switzerland . |

*Primary Examiner*—James Lisehora

*Attorney, Agent, or Firm*—Fulwider Patton Lee & Utecht, LLP

[57] ABSTRACT

A road marker (10) comprising a body (12) extruded from a non-resilient material is disclosed and claimed. The marker body comprises a sloping wide base (14), a neck (18) and a head (16) and is generally I-shaped in transverse cross section. The cross-sectional area of the neck (18) on line A is less than that of the head (16) and that of base (14) in parallel planes.

8 Claims, 4 Drawing Sheets

REFLECTOR STUDS FOR ROADS

INTRODUCTION AND BACKGROUND

THIS invention relates to markers for roads or pavements or so-called cat's eyes.

The road markers known to the applicant suffer from at least one of the following disadvantages. These markers are primarily made by an injection moulding process of a suitable metal or synthetic resinous material which makes them and their moulds relatively expensive. Due to their structure and to ensure stable anchorage in the pavement or road surface, their reflector elements are located too close to the road surface, so that soiling of these elements occur. Furthermore, due to their structure, rocking of the marker occurs upon impact with a vehicle wheel, which causes the marker to become loose in the road structure.

In U.S. Pat. No. 4,127,348 to Roberts there is disclosed a road marker with a complex shape including skirts to protect the reflector elements. The marker body is formed of aluminium as a die casting. This marker suffers from the disadvantage that due to its process of manufacture, it is relatively expensive and time-consuming to produce. Furthermore, the reflector elements are located too close to the road surface and soiling of the rather obscured reflectors can easily take place. Still furthermore, the skirts, in use, entrap dirt which is not readily removed by rain and/or traffic action.

In U.S. Pat. Nos. 4,521,129 and 4,534,763 to Minnesota Mining and Manufacturing Company there are disclosed road markers produced by an extrusion process from a resiliently flexible material. The reflector of the marker comprises a reflective film adhered to a surface of the marker body which, in use, faces oncoming traffic. It is believed that as a result of the deformation of the marker every time it is struck by a wheel of a vehicle, the marker body and/or film will be damaged. The marker is also highly susceptible to damage by vandals. Furthermore, the marker is clearly not suitable for use on roads carrying traffic in opposite directions.

OBJECT OF THE INVENTION

Accordingly it is an object of the present invention to provide a road marker, a body for such a marker and a method of producing same with which the applicant believes the aforementioned disadvantages will at least be alleviated.

SUMMARY OF THE INVENTION

According to the invention there is provided a road marker comprising a body extruded from a rigid material and reflector means mounted on the body, the body comprising a base and interconnection means connecting the base to at least one overhang above the base, the reflector means being mounted between the overhang and the base, in use, to be exposed at an obtuse angle to approaching traffic.

In a first embodiment of the invention the marker may comprise a head formation and the interconnection means may comprise a neck formation extending away from the base to the head formation on another side of the base as a bottom surface of the base, at least part of the neck formation having a cross-sectional area in a plane parallel to said bottom surface less than a cross-sectional area of the head formation in a region thereof adjacent to the neck formation in a plane parallel to said bottom surface and also less than the cross-sectional area of said bottom surface, so that the body is substantially uniformly I-shaped in cross section and so that the head formation provides said at least one overhang above said base.

The base may be rectangular and the neck formation may be elongated and may extend intermediate two opposed sides of the base from one end region of the base to an opposite end region of the base.

Sides of the neck formation facing said opposed sides of the base may slant from a relatively wider region of the neck formation towards one another in a direction towards the head formation to a relatively narrower region of the neck formation and a cross-sectional area of the neck formation in said wider region thereof is preferably less than 30% of that of the bottom surface of the base.

Opposed ends of the elongate neck formation may slant towards one another in a direction towards the head formation.

In a preferred form of the first embodiment of the invention any cross sectional area of head formation parallel to the bottom surface of the base is less than 25% of that of the bottom surface of the base.

A top surface of the base may provide a rising ramp from each of said opposed sides of the base in a direction towards the neck formation.

Opposed slots may be defined immediately adjacent the neck formation in the base and in said at least one overhang respectively, for locating said reflector means.

The reflector means may comprise a disc received in said opposed slots and which disc carries a plurality of reflective elements.

A plurality of slots may be provided in the bottom surface of the base to extend parallel to said opposed sides of the base, at least some of the slots having a dovetail shape in transverse cross-section with a narrower region of the slot located in a plane of the bottom surface of the base.

Anchor means may be provided in the bottom surface of the base to extend in a direction opposite the neck formation.

According to a second embodiment of the invention the road marker may comprise a convexo-concave base and the interconnection means may comprise integral rising formations extending beyond said concave surface of the base at opposed end regions of the base and said at least one overhang may comprise first and second overhangs extending towards one another from said opposed rising formations respectively.

According to another aspect of the invention a body for a road marker is extruded from a rigid material, the body comprising a base and interconnection means connecting the base to at least one overhang above the base, the body defining opposed slots in the base and in said at least one overhang, for slidingly receiving reflector means.

According to yet another aspect of the invention a method of producing a road marker comprises the steps of extruding a non-resilient material into a marker body comprising a base and at least one overhang interconnected by interconnection means, so that said at least one overhang overhangs the base; and subsequently mounting reflector means on the body in opposed slots defined in the base and said at least one overhang.

The reflector means may be secured to the body by mechanically arresting it on the body. For example, the reflector means may be so arrested by local deformation of said at least one overhang beyond at least one end of said reflector means.

BRIEF DESCRIPTION OF THE DIAGRAMS

The invention will now further be described, by way of example only, with reference to the accompanying diagrams wherein.

DESCRIPTION OF A PREFERRED EMBODIMENTS Of THE INVENTION

Figure 1:
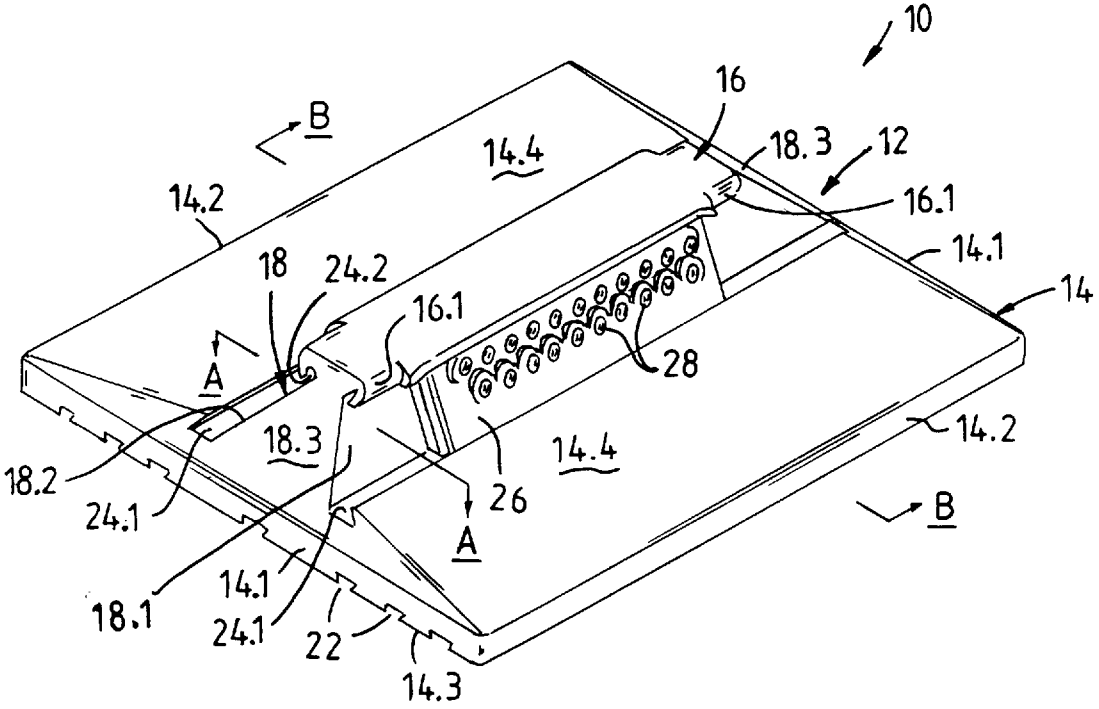
FIG. 1 is a perspective view of a first embodiment of a road marker according to the invention.
Figure 2:
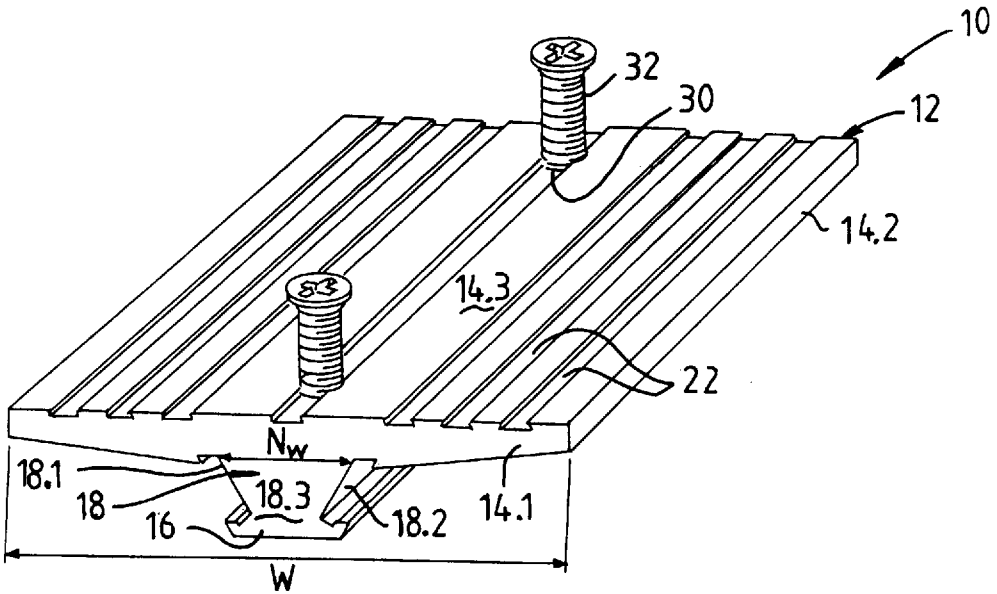
FIG. 2 is a perspective view of the marker in FIG 1, shown from a bottom thereof.
Figure 3:
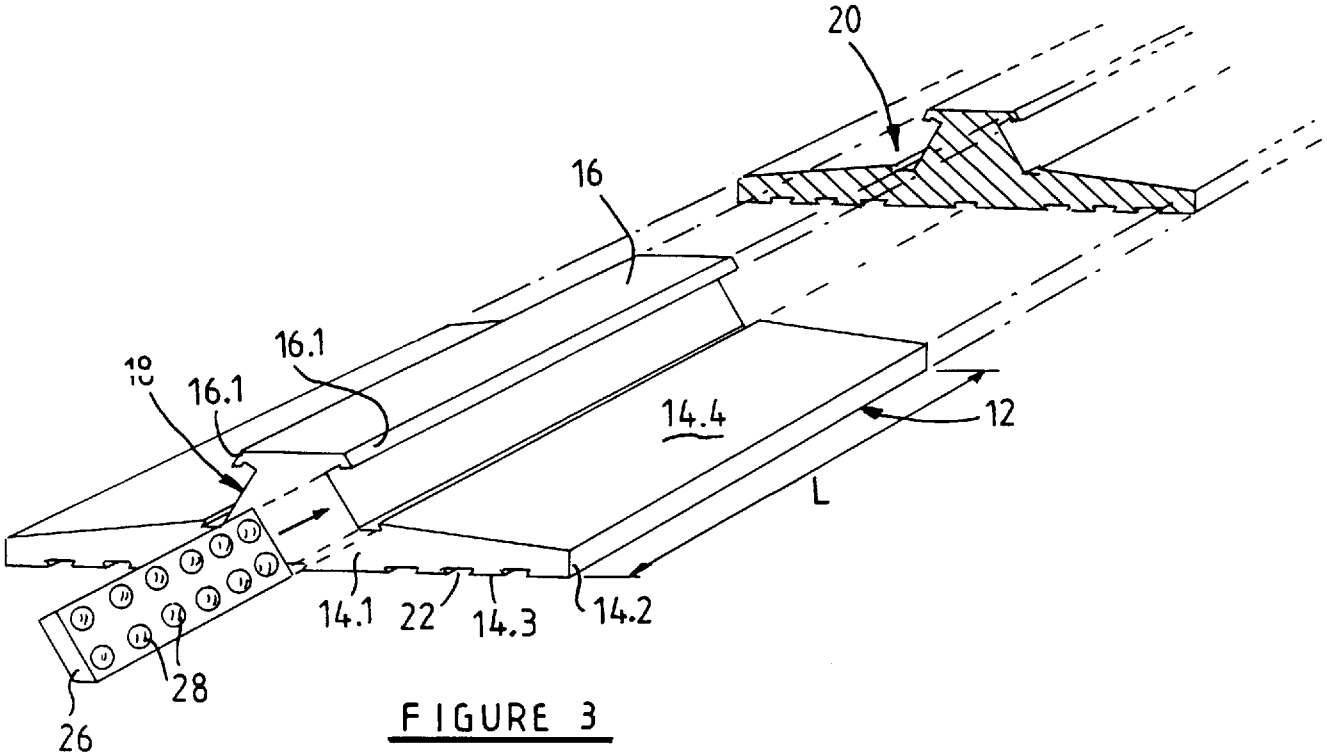
FIG. 3 is an exploded perspective view of a marker according to the invention, severed from an extrusion from which its body is formed.

In FIGS. 1 to 3, a first embodiment of a cat's eye or road marker according to the invention is generally designated by the reference numeral 10.

The marker 10 comprises a body 12 having a rectangular base 14 and an elongate head 16 interconnected by an elongate neck 18. The base 14, neck 18 and head 16 are integrally formed in a metal or rigid plastics extrusion 20 (shown in FIG. 3) and the marker body 12 is formed by severing it from the extrusion 20. The metal is preferably aluminium and the rigid plastic is preferably polycarbonate.

The neck 18 extends between two opposed ends 14.1 of the base 14 and is located halfway between two opposed sides 14.2 thereof.

The neck comprises two opposed elongate outer surfaces 18.1 and 18.2 sloping towards one another from a relatively wider region of the neck adjacent base 14 to a relatively narrower region adjacent head 16. The Two opposed ends 18.3 and 18.4 of the neck 18 also slope inwardly towards one another.

The transverse cross-sectional area of the neck 18 on line A is less than that of bottom surface 14.3 of base 14 and less than that of the head 16 in a region thereof adjacent neck 18 in a plane parallel to that of bottom surface 14.3, Accordingly, the body 12 has a uniform generally I-shape when sectioned and viewed on line B and lines parallel thereto.

The base 14 defines a plurality of parallel dovetail shaped slots 22 in a bottom surface 14.3 thereof. The narrower ends of slots 22 lie in the plane of bottom surface 14.3.

In a top region thereof, the base 14 provides ramps 14.4 extending away from the bottom surface 14.3 in a direction from the sides 14.2 of the base towards the neck 18. The minimum distance of the ramps 14.4 from the bottom surface 14.3 Is typically 4 mm and they form angles of in the order of 51° with the bottom surface 14.3.

In the top surface of base 14 and the lower surfaces of the overhangs 16.1 of head 16, adjacent each of surfaces 18.1 and 18.2, there are defined mutually facing elongate slots 24.1 and 24.2.

Carriers 26 for reflective elements 28 are removably and slidingly receivable in the open ended opposed slots to abut against surfaces 18.1 and 18.2 and to extend between the overhangs 16.1 and the base 14. The carriers 26 are mechanically arrested on the body by bending the overhanging regions 16.1 of the head outside the carriers 26 towards base 14.

The markers are secured to a road surface (not shown) by a suitable adhesive which, when cured, forms a key in each of slots 22.

As best shown in FIG. 2, in the bottom surface 14.3 of base 14, there are also defined threaded holes 30. In use, bolts 32 may be threaded into the holes 30 to serve as additional anchors for the markers 10 in the road or pavement structure.

As shown in FIG. 3, the body 12 is formed by severing a selected length L (100 mm, 150 mm, 200 mm or 250 mm or longer) from aluminium extrusion 20, thereby providing an integral structure. Thereafter the end regions 18.3 and 18.4 of the neck 18 and head 16 are machined away. As shown in FIG. 2, the dimension W of the body along end 14.1 of the base 14, is typically in the order of 100 mm and the dimension of the aforementioned wider region N of neck 18 is typically less than 30% thereof.

The maximum cross sectional area of the head 16 in a plane parallel to the bottom surface 14.3 of the base is typically in the order of 20% of that of the rectangular area wherein bottom surface 14.3 of the base is located. With a base 14 of 100 mm×100 mm or 150 mm or 200 mm, the distance between the top surface of the head and the bottom surface of the base is in the order of 22 mm, according to the international standards.

It will be appreciated that with the relatively small head 16 (which comes into contact with vehicle wheels) compared to the base 14, rocking of the stud upon impact with a vehicle wheel is reduced. Furthermore, as a result of the wide and sloping base 14, the carriers 26 and reflectors 28 are further removed from the road surface as is the case with the prior art markers, so that damage and soiling of the reflectors are also reduced.

The method of manufacture and the marker 10 according to the invention and the marker system provide flexibility in that the marker size may easily be changed by severing shorter or longer bodies 12 from the extrusion 20. Furthermore, a large variety of known reflector carriers may easily and conveniently be mounted on the body, thereby to provide a customer with a wide selection at relatively low cost. Such reflector carriers include forty-three element carriers, twenty-three element carriers and seven element carriers of which the retro-reflective lenses may be any one of white, red, amber, green and blue in colour and which are being sold under the trade name "Swareflex".

In some embodiments, especially when a longer (250 mm) body 12 is used, more than one reflector carrier 26 may be provided adjacent each of sidewalls 18.1 and 18.2 of the neck 18.

Figure 4:
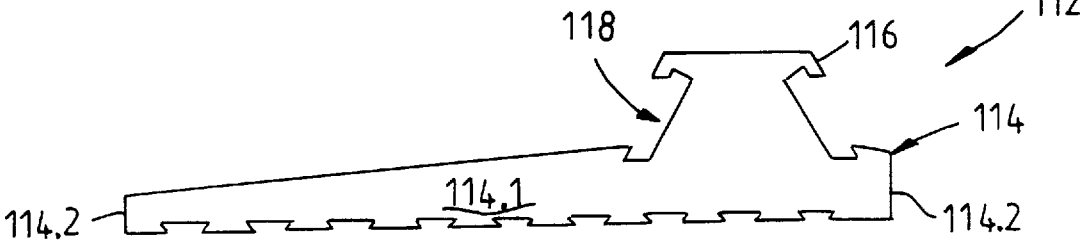
FIG. 4 is a diagrammatic end view of a second embodiment of the road marker according to the invention.

In FIG. 4, there is shown a second embodiment of the marker body according to the invention designated 112 and which is substantially similar to the body 12 of FIGS. 1 to 3, except that the neck 118 connecting head 116 to base 114 is not located halfway between the two opposed sides 114.2 of base 114, but is located substantially at one side of the base 114.

It will be appreciated that there are many variations in detail on the markers, the marker bodies, the method or producing same and the marker system according to the invention without departing from the scope and spirit of the appended claims.

I claim:

1. A rigid road marker adapted to be mounted to a road surface, the road marker comprising:

a base having a bottom surface and an upper surface;

a neck extending from a region of the upper surface of the base towards a head;

the base, the neck and the head being integrally formed by an extrusion process;

the neck being of sloping configuration in that at least one of two opposed side faces thereof slants from a wide lower region of the neck immediately adjacent the upper surface of the base to a narrower upper region of the neck immediately adjacent the head;

the head comprising an overhanging surface facing the base and at least partially overhanging said at least one of said two opposed side faces;

reflector means mounted on the body immediately adjacent said at least one of said two opposed side faces of the neck, between said overhanging surface and the upper surface of the base;

the cross sectional area of the wide lower region of the neck being less than 30% of that of the bottom surface of the base, and the cross sectional area of the head being less than 25% of that of the bottom surface of the base, to thereby minimize rocking of the road marker on the road surface.

2. A road marker as claimed in claim 1 wherein the base is rectangular, wherein the neck is elongated and extends intermediate two opposed sides of the base from one end region of the base to an opposite end region of the base and with said opposed side faces of the neck facing said two opposed sides of the base.

3. A road marker as claimed in claim 2 wherein opposed ends of the elongate neck slant towards one another in a direction towards the head.

4. A road marker as claimed in claim 2 wherein the upper surface of the base provides a rising ramp from each of said opposed sides of the base in a direction towards the neck.

5. A road marker as claimed in claim 1 wherein slots are provided in the bottom surface of the base, each of said slots having a dovetail shape in transverse cross-section with a narrower region of the slot located in a plane of the bottom surface of the base.

6. A road marker as claimed in claim 1 wherein opposed slots are defined immediately adjacent said at least one of said two opposed side faces of the neck in the base and in said overhanging surface respectively, for locating the reflector means.

7. A road marker as claimed in claim 6 wherein the reflector means comprises a rigid disc carrying a plurality of reflective elements.

8. A body for a road marker adapted to be mounted to a road surface the body for the road marker comprising:

a base having a bottom surface and an upper surface;

a neck extending from a region of the upper surface of the base towards a head;

the base, the neck and the head being integrally formed by an extrusion process;

the neck being of sloping configuration in that at least one of two opposed side faces thereof slants from a wide lower region of the neck immediately adjacent the upper surface of the base to a narrow upper region of the neck immediately adjacent the head;

the head comprising an overhanging surface facing the base and at least partially overhanging said at least one of said two opposed side faces;

the upper surface of the base and the overhanging surface of the head providing opposed formations for receiving reflector means immediately adjacent said at least one of said two opposed side faces of the neck;

the cross sectional area of the wide lower region of the neck being less than 30% of that of the upper surface of the base; and the surface area of the head being less than 25% of that of the bottom surface of the base, to thereby minimize rocking of the road marker on the road surface.

* * * * *